US007679613B2

(12) United States Patent
Allen

(10) Patent No.: US 7,679,613 B2
(45) **Date of Patent: *Mar. 16, 2010**

(54) IMAGE DISPLAY SYSTEM AND METHOD

(75) Inventor: William Allen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1010 days.

This patent is subject to a terminal disclaimer.

(21) Appl. No.: 11/301,723

(22) Filed: Dec. 13, 2005

(65) Prior Publication Data

US 2006/0092151 A1 May 4, 2006

Related U.S. Application Data

(63) Continuation of application No. 10/242,195, filed on Sep. 11, 2002, now Pat. No. 7,034,811, which is a continuation-in-part of application No. 10/213,555, filed on Aug. 7, 2002, now Pat. No. 7,030,894.

(51) Int. Cl.
*G09G 5/00* (2006.01)

(52) U.S. Cl. ..... 345/204; 345/32; 345/56; 348/513; 359/275; 359/299

(58) Field of Classification Search ..... 345/8, 345/9, 32, 56, 87, 204, 698, 699; 348/511, 348/513, 746, 747, 755, 771; 359/224, 291, 359/317, 495; 382/210, 275, 299, 300
See application file for complete search history.

(56) References Cited

U.S. PATENT DOCUMENTS 4,573,070 A 2/1986 Cooper
4,662,746 A 5/1987 Hornbeck
4,751,659 A 6/1988 Hecht et al.
4,827,334 A 5/1989 Johnson et al.

(Continued)

FOREIGN PATENT DOCUMENTS

EP 0 364 043 A1 4/1990

(Continued)

OTHER PUBLICATIONS

Tokita et al, "FLC Rescolution-Enhancing Device for Projection Displays", SID Int'l Symp Digest, May 21-23, 2002.

(Continued)

*Primary Examiner*—Henry N Tran

(57) ABSTRACT

A method of displaying an image with a display device including a plurality of display pixels includes receiving image data for the image, the image data including individual pixels of the image; buffering the image data and creating a frame of the image, the frame of the image including a plurality of columns and a plurality of rows of the pixels of the image; defining a first sub-frame and at least a second sub-frame for the frame of the image, image data of the second sub-frame being offset from image data of the first sub-frame by an offset distance of at least one pixel; and displaying the first sub-frame with a first plurality of the display pixels and displaying the second sub-frame with a second plurality of the display pixels offset from the first plurality of the display pixels by the offset distance.

34 Claims, 13 Drawing Sheets

U.S. PATENT DOCUMENTS 4,870,950 A 10/1989 Kanbara et al.
4,956,619 A 9/1990 Hornbeck
5,032,924 A 7/1991 Brown et al.
5,061,049 A 10/1991 Hornbeck
5,079,544 A 1/1992 DeMond et al.
5,083,857 A 1/1992 Hornbeck
5,105,265 A 4/1992 Sato et al.
5,109,290 A 4/1992 Imai
5,386,253 A 1/1995 Fielding
5,402,184 A 3/1995 O'Grady et al.
5,424,780 A 6/1995 Cooper
5,448,314 A 9/1995 Heimbuch et al.
5,475,428 A 12/1995 Hintz et al.
5,490,009 A 2/1996 Venkateswar et al.
5,530,482 A 6/1996 Gove et al.
5,537,256 A 7/1996 Fergason
5,612,708 A 3/1997 Ansley et al.
5,657,165 A 8/1997 Karpman et al.
5,689,283 A 11/1997 Shirochi
5,742,274 A 4/1998 Henry et al.
5,748,250 A 5/1998 Markandey et al.
5,796,442 A 8/1998 Gove et al.
5,822,025 A 10/1998 Borel et al.
5,842,762 A 12/1998 Clarke
5,844,663 A 12/1998 Holley et al.
5,897,191 A 4/1999 Clarke
5,978,518 A 11/1999 Oliyide et al.
6,025,951 A 2/2000 Swart et al.
6,061,103 A 5/2000 Okamura et al.
6,084,235 A 7/2000 Breithaupt et al.
6,104,375 A 8/2000 Lam
6,124,876 A 9/2000 Sunagawa
6,141,039 A 10/2000 Poetsch
6,184,969 B1 2/2001 Fergason
6,219,017 B1 * 4/2001 Shimada et al. ..... 345/88
6,239,783 B1 5/2001 Hill et al.
6,243,055 B1 6/2001 Fergason
6,266,086 B1 7/2001 Okada et al.
6,313,888 B1 11/2001 Tabata
6,317,169 B1 11/2001 Smith
6,340,994 B1 1/2002 Margulis et al.
6,366,387 B1 4/2002 Wilson
6,384,816 B1 5/2002 Tabata
6,393,145 B2 5/2002 Betrisey et al.
6,529,637 B1 3/2003 Cooper
6,574,032 B1 * 6/2003 Roddy et al. ..... 359/290
6,600,514 B1 7/2003 Van Asma et al.
6,619,801 B2 9/2003 Cho et al.
6,657,603 B1 12/2003 Demetrescu et al.
6,664,940 B2 12/2003 Wolfe
6,751,005 B1 6/2004 Barnick et al.
6,791,512 B1 9/2004 Shimada
6,817,718 B2 11/2004 Katoh
6,825,835 B2 11/2004 Sano et al.
7,019,881 B2 3/2006 Doherty et al.
2002/0008812 A1 1/2002 Conner et al.
2002/0075202 A1 6/2002 Fergason
2002/0135729 A1 9/2002 Tokita et al.
2003/0020809 A1 1/2003 Gibbon et al.
2003/0128321 A1 7/2003 Nakanishi
2003/0132901 A1 7/2003 Shimada
2003/0133060 A1 7/2003 Shimada
2003/0142197 A1 7/2003 Donner et al.
2003/0147015 A1 8/2003 Katoh et al.
2003/0231270 A1 12/2003 Kume et al.
2004/0036701 A1 2/2004 Wolfe
2004/0036834 A1 2/2004 Ohnishi et al.
2004/0041784 A1 3/2004 Cho et al.
2004/0085486 A1 5/2004 Katoh et al.
2004/0120026 A1 6/2004 Barnick et al.
2004/0239885 A1 12/2004 Jaynes et al.
2005/0024391 A1 2/2005 Damera-Venkata et al.
2005/0078278 A1 4/2005 Uehara et al.

FOREIGN PATENT DOCUMENTS

EP 0 492 661 A2 7/1992
EP 0 492 721 A2 7/1992
EP 0 509 630 A2 10/1992
EP 00509630 A2 10/1992
EP 00509630 A3 10/1992
EP 0 805 429 A 11/1997
EP 0 887 689 A 12/1998
EP 1001306 5/2000
EP 1001306 A2 5/2000
EP 1 388 838 A 2/2004
EP 1 388 840 A 2/2004
GB 2 142 203 A 1/1985
JP 60-132476 12/1983
JP 60 083486 5/1985
JP 63-292880 5/1987
JP 62 191817 8/1987
JP 64-47180 8/1987
JP 63 292880 11/1988
JP 63 294521 12/1988
JP 63 306792 12/1988
JP 64 003834 1/1989
JP 2-216187 2/1989
JP 2-250081 3/1989
JP 02 216187 8/1990
JP 02 250081 10/1990
JP 03 198037 8/1991
JP 03 250990 11/1991
JP 5-289044 11/1991
JP 04 060625 2/1992
JP 04 063332 2/1992
JP 4-63332 2/1992
JP 04 113308 4/1992
JP 04 253044 9/1992
JP 05 088280 4/1993
JP 05 142654 6/1993
JP 05 313116 11/1993
JP 06 265867 9/1994
JP 06 273719 9/1994
JP 06 324320 11/1994
JP 06 343178 12/1994
JP 06 347746 12/1994
JP 07 007704 1/1995
JP 07 007705 1/1995
JP 07 030822 1/1995
JP 07 036054 2/1995
JP 07 043670 2/1995
JP 07 064048 3/1995
JP 07 104239 4/1995
JP 07 104278 4/1995
JP 07 134275 5/1995
JP 08 021973 1/1996
JP 08 194207 7/1996
JP 09 133904 5/1997
JP 9-230833 9/1997
JP 10 068997 3/1998
JP 10 133135 5/1998
JP 10 222131 8/1998
JP 10 282574 10/1998
JP 11 298829 10/1999
JP 2000 105362 4/2000
JP 2000 147677 5/2000
JP 2001 005113 1/2001
JP 2001 016600 1/2001
JP 2001-157229 6/2001
JP 2001 356316 12/2001
JP 2001-356411 12/2001
JP 2001 356731 12/2001
JP 2001-359112 12/2001

| | | |
|---|---|---|
| JP | 2002 107664 | 4/2002 |
| JP | 2003-302952 | 10/2003 |
| WO | WO 9820475 | 5/1998 |

OTHER PUBLICATIONS

T. Tokita et al., "P-108: FLC Resolution-Enhancing Device for Projection Displays", SID 02 Digest, 2002, pp. 638,641.

D. Chen, "Display Resolution Enhancement With Optical Scanners", Applied Optics, vol. 40, No. 5, Feb. 10, 2001, pp. 636-643.

A. Yasuda et al., "FLC Wobbling for High Resolution Projectors", Journal of the SID 5/3, 1997, pp. 299-305.

* cited by examiner

62

(WITH TWO-POSITION PROCESSING)

60

(WITHOUT PROCESSING)

66

(WITH FOUR-POSITION PROCESSING)

64

(WITHOUT PROCESSING)

14

| | i | ii | iii | iv |
|---|---|---|---|---|
| a | $I_A + I_B +$ $I_C + I_D$ | $II_A + II_B +$ $II_C + II_D$ | $III_A + III_B +$ $III_C + III_D$ | $IV_A + IV_B +$ $IV_C + IV_D$ |
| b | $V_A + V_B +$ $V_C + V_D$ | $D_A + VI_B +$ $VI_C + VI_D$ | $VII_A + D_B +$ $VII_C + VII_D$ | $VIII_A + VIII_B +$ $VIII_C + VIII_D$ |
| c | $IX_A + IX_B +$ $IX_C + IX_D$ | $X_A + X_B +$ $X_C + D_D$ | $XI_A + XI_B +$ $D_C + XI_D$ | $XII_A + XII_B +$ $XII_C + XII_D$ |
| d | $XIII_A + XIII_B +$ $XIII_C + XIII_D$ | $XIV_A + XIV_B +$ $XIV_C + XIV_D$ | $XV_A + XV_B +$ $XV_C + XV_D$ | $XVI_A + XVI_B +$ $XVI_C + XVI_D$ |

*Fig. 15*

(WITH FOUR-POSITION PROCESSING)

(WITHOUT PROCESSING)

IMAGE DISPLAY SYSTEM AND METHOD

CROSS-REFERENCE TO RELATED APPLICATIONS

This application is a Continuation of U.S. patent application Ser. No. 10/242,195, filed on Sep. 11, 2002 now U.S. Pat. No. 7,034,811, which is a Continuation-In-Part of U.S. patent application Ser. No. 10/213,555, filed on Aug. 7, 2002 now U.S. Pat. No. 7,030,894, both of which are assigned to the assignee of the present invention, and incorporated herein by reference. These applications are related to U.S. patent application Ser. No. 10/242,545, filed on Sep. 11, 2002, now U.S. Pat. No. 6,963,319, assigned to the assignee of the present invention, and incorporated herein by reference.

THE FIELD OF THE INVENTION

The present invention relates generally to imaging systems, and more particularly to a system and method of displaying an image.

BACKGROUND OF THE INVENTION

A conventional system or device for displaying an image, such as a display, projector, or other imaging system, produces a displayed image by addressing an array of individual picture elements or pixels arranged in horizontal rows and vertical columns. Unfortunately, if one or more of the pixels of the display device is defective, the displayed image will replicate the defect. For example, if a pixel of the display device exhibits only an "ON" position, the pixel may produce a solid white square in the displayed image. In addition, if a pixel of the display device exhibits only an "OFF" position, the pixel may produce a solid black square in the displayed image. Thus, the affect of the defective pixel or pixels of the display device may be readily visible in the displayed image.

SUMMARY OF THE INVENTION

One aspect of the present invention provides a method of displaying an image with a display device including a plurality of display pixels. The method includes receiving image data for the image, the image data including individual pixels of the image; buffering the image data and creating a frame of the image, the frame of the image including a plurality of columns and a plurality of rows of the pixels of the image; defining a first sub-frame and at least a second sub-frame for the frame of the image, image data of the second sub-frame being offset from image data of the first sub-frame by an offset distance of at least one pixel; and displaying the first sub-frame with a first plurality of the display pixels and displaying the second sub-frame with a second plurality of the display pixels offset from the first plurality of the display pixels by the offset distance.

BRIEF DESCRIPTION OF THE DRAWINGS

FIG. 15 is a schematic illustration of one embodiment of display of the image data for the image frame of FIG. 11 with an image display system according to the present invention.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
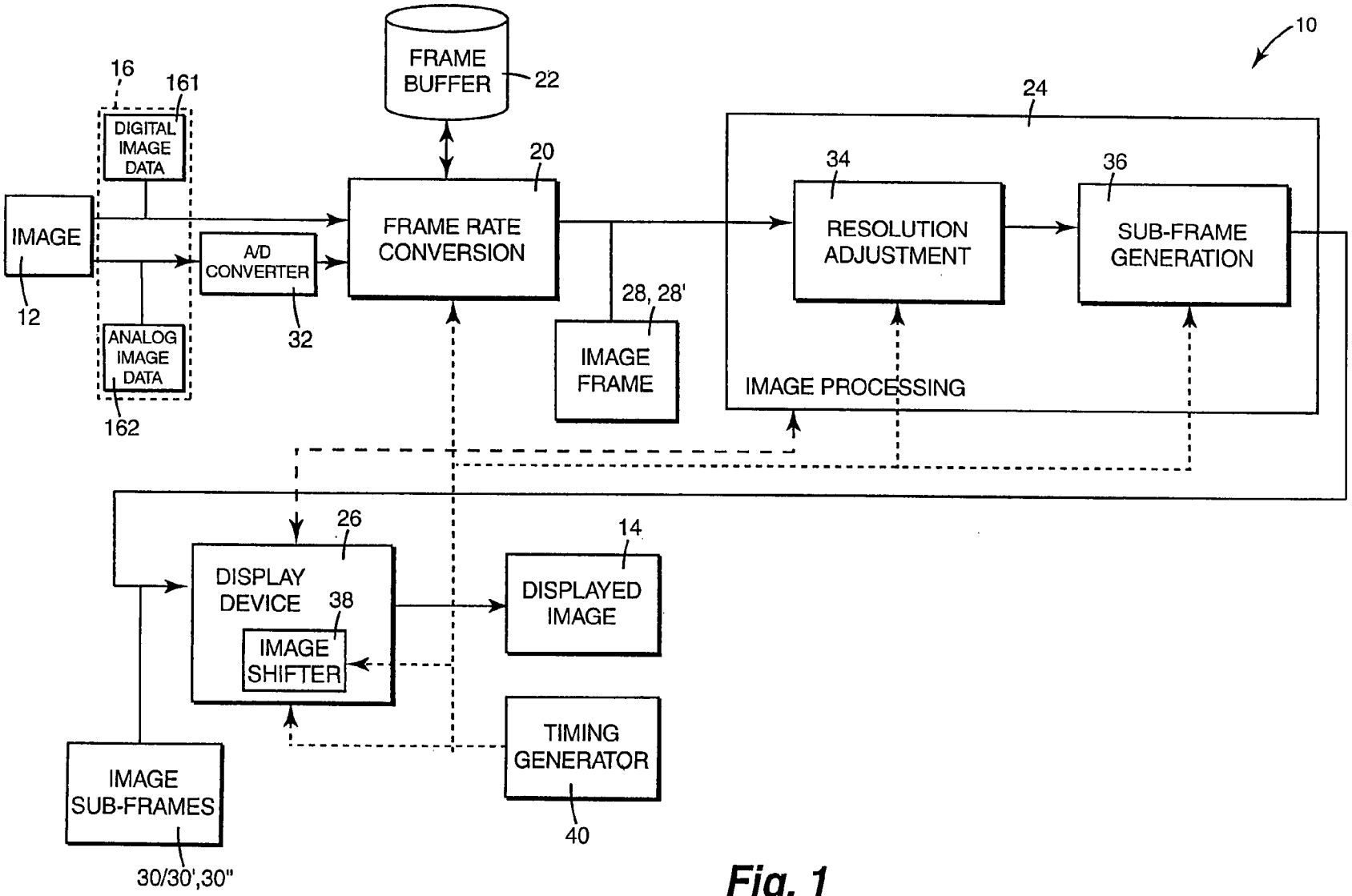
FIG. 1 is a block diagram illustrating one embodiment of an image display system.

FIG. 1 illustrates one embodiment of an image display system 10. Image display system 10 facilitates processing of an image 12 to create a displayed image 14. Image 12 is defined to include any pictorial, graphical, and/or textural characters, symbols, illustrations, and/or other representation of information. Image 12 is represented, for example, by image data 16. Image data 16 includes individual picture elements or pixels of image 12. While one image is illustrated and described as being processed by image display system 10, it is understood that a plurality or series of images may be processed and displayed by image display system 10.

In one embodiment, image display system 10 includes a frame rate conversion unit 20 and an image frame buffer 22, an image processing unit 24, and a display device 26. As described below, frame rate conversion unit 20 and image frame buffer 22 receive and buffer image data 16 for image 12 to create an image frame 28 for image 12. In addition, image processing unit 24 processes image frame 28 to define one or more image sub-frames 30 for image frame 28, and display device 26 temporally and spatially displays image sub-frames 30 to produce displayed image 14.

Image display system 10, including frame rate conversion unit 20 and/or image processing unit 24, includes hardware, software, firmware, or a combination of these. In one embodiment, one or more components of image display system 10, including frame rate conversion unit 20 and/or image processing unit 24, are included in a computer, computer server, or other microprocessor-based system capable of performing a sequence of logic operations. In addition, processing can be distributed throughout the system with individual portions being implemented in separate system components.

Image data 16 may include digital image data 161 or analog image data 162. To process analog image data 162, image display system 10 includes an analog-to-digital (A/D) converter 32. As such, A/D converter 32 converts analog image data 162 to digital form for subsequent processing. Thus, image display system 10 may receive and process digital image data 161 and/or analog image data 162 for image 12.

Frame rate conversion unit 20 receives image data 16 for image 12 and buffers or stores image data 16 in image frame buffer 22. More specifically, frame rate conversion unit 20 receives image data 16 representing individual lines or fields of image 12 and buffers image data 16 in image frame buffer 22 to create image frame 28 for image 12. Image frame buffer 22 buffers image data 16 by receiving and storing all of the image data for image frame 28 and frame rate conversion unit 20 creates image frame 28 by subsequently retrieving or extracting all of the image data for image frame 28 from image frame buffer 22. As such, image frame 28 is defined to include a plurality of individual lines or fields of image data 16 representing an entirety of image 12. Thus, image frame 28 includes a plurality of columns and a plurality of rows of individual pixels representing image 12.

Frame rate conversion unit 20 and image frame buffer 22 can receive and process image data 16 as progressive image data and/or interlaced image data. With progressive image data, frame rate conversion unit 20 and image frame buffer 22 receive and store sequential fields of image data 16 for image 12. Thus, frame rate conversion unit 20 creates image frame 28 by retrieving the sequential fields of image data 16 for image 12. With interlaced image data, frame rate conversion unit 20 and image frame buffer 22 receive and store odd fields and even fields of image data 16 for image 12. For example, all of the odd fields of image data 16 are received and stored and all of the even fields of image data 16 are received and stored. As such, frame rate conversion unit 20 de-interlaces image data 16 and creates image frame 28 by retrieving the odd and even fields of image data 16 for image 12.

Image frame buffer 22 includes memory for storing image data 16 for one or more image frames 28 of respective images 12. Thus, image frame buffer 22 constitutes a database of one or more image frames 28. Examples of image frame buffer 22 include non-volatile memory (e.g., a hard disk drive or other persistent storage device) and may include volatile memory (e.g., random access memory (RAM)).

By receiving image data 16 at frame rate conversion unit 20 and buffering image data 16 with image frame buffer 22, input timing of image data 16 can be decoupled from a timing requirement of display device 26. More specifically, since image data 16 for image frame 28 is received and stored by image frame buffer 22, image data 16 can be received as input at any rate. As such, the frame rate of image frame 28 can be converted to the timing requirement of display device 26. Thus, image data 16 for image frame 28 can be extracted from image frame buffer 22 at a frame rate of display device 26.

In one embodiment, image processing unit 24 includes a resolution adjustment unit 34 and a sub-frame generation unit 36. As described below, resolution adjustment unit 34 receives image data 16 for image frame 28 and adjusts a resolution of image data 16 for display on display device 26, and sub-frame generation unit 36 generates a plurality of image sub-frames 30 for image frame 28. More specifically, image processing unit 24 receives image data 16 for image frame 28 at an original resolution and processes image data 16 to match the resolution of display device 26. For example, image processing unit 24 increases, decreases, and/or leaves unaltered the resolution of image data 16 so as to match the resolution of display device 26. Thus, by matching the resolution of image data 16 to the resolution of display device 26, display device 26 can display image data 16. Accordingly, with image processing unit 24, image display system 10 can receive and display image data 16 of varying resolutions.

In one embodiment, image processing unit 24 increases a resolution of image data 16. For example, image data 16 may be of a resolution less than that of display device 26. More specifically, image data 16 may include lower resolution data, such as 400 pixels by 300 pixels, and display device 26 may support higher resolution data, such as 800 pixels by 600 pixels. As such, image processing unit 24 processes image data 16 to increase the resolution of image data 16 to the resolution of display device 26. Image processing unit 24 may increase the resolution of image data 16 by, for example, pixel replication, interpolation, and/or any other resolution synthesis or generation technique.

In one embodiment, image processing unit 24 decreases a resolution of image data 16. For example, image data 16 may be of a resolution greater than that of display device 26. More specifically, image data 16 may include higher resolution data, such as 1600 pixels by 1200 pixels, and display device 26 may support lower resolution data, such as 800 pixels by 600 pixels. As such, image processing unit 24 processes image data 16 to decrease the resolution of image data 16 to the resolution of display device 26. Image processing unit 24 may decrease the resolution of image data 16 by, for example, sub-sampling, interpolation, and/or any other resolution reduction technique.

Sub-frame generation unit 36 receives and processes image data 16 for image frame 28 to define a plurality of image sub-frames 30 for image frame 28. If resolution adjustment unit 34 has adjusted the resolution of image data 16, sub-frame generation unit 36 receives image data 16 at the adjusted resolution. The adjusted resolution of image data 16 may be increased, decreased, or the same as the original resolution of image data 16 for image frame 28. Sub-frame generation unit 36 generates image sub-frames 30 with a resolution which matches the resolution of display device 26. Image sub-frames 30 are each of an area equal to image frame 28 and each include a plurality of columns and a plurality of rows of individual pixels representing a subset of image data 16 of image 12 and have a resolution which matches the resolution of display device 26.

Each image sub-frame 30 includes a matrix or array of pixels for image frame 28. Image sub-frames 30 are spatially offset from each other such that each image sub-frame 30 includes different pixels and/or portions of pixels. As such, image sub-frames 30 are offset from each other by a vertical distance and/or a horizontal distance, as described below.

Display device 26 receives image sub-frames 30 from image processing unit 24 and sequentially displays image sub-frames 30 to create displayed image 14. More specifically, as image sub-frames 30 are spatially offset from each other, display device 26 displays image sub-frames 30 in different positions according to the spatial offset of image sub-frames 30, as described below. As such, display device 26 alternates between displaying image sub-frames 30 for image frame 28 to create displayed image 14. Accordingly, display device 26 displays an entire sub-frame 30 for image frame 28 at one time.

In one embodiment, display device 26 completes one cycle of displaying image sub-frames 30 for image frame 28. Thus, display device 26 displays image sub-frames 30 so as to be spatially and temporally offset from each other. In one embodiment, display device 26 optically steers image sub-frames 30 to create displayed image 14. As such, individual pixels of display device 26 are addressed to multiple locations.

In one embodiment, display device 26 includes an image shifter 38. Image shifter 38 spatially alters or offsets the position of image sub-frames 30 as displayed by display device 26. More specifically, image shifter 38 varies the position of display of image sub-frames 30, as described below, to produce displayed image 14.

In one embodiment, display device 26 includes a light modulator for modulation of incident light. The light modulator includes, for example, a plurality of micro-mirror devices arranged to form an array of micro-mirror devices. As such, each micro-mirror device constitutes one cell or pixel of display device 26. Display device 26 may form part of a display, projector, or other imaging system.

In one embodiment, image display system 10 includes a timing generator 40. Timing generator 40 communicates, for example, with frame rate conversion unit 20, image processing unit 24, including resolution adjustment unit 34 and sub-frame generation unit 36, and display device 26, including image shifter 38. As such, timing generator 40 synchronizes buffering and conversion of image data 16 to create image frame 28, processing of image frame 28 to adjust the resolution of image data 16 to the resolution of display device 26 and generate image sub-frames 30, and display and positioning of image sub-frames 30 to produce displayed image 14. Accordingly, timing generator 40 controls timing of image display system 10 such that entire sub-frames of image 12 are temporally and spatially displayed by display device 26 as displayed image 14.

Resolution Enhancement

Figure 2C:
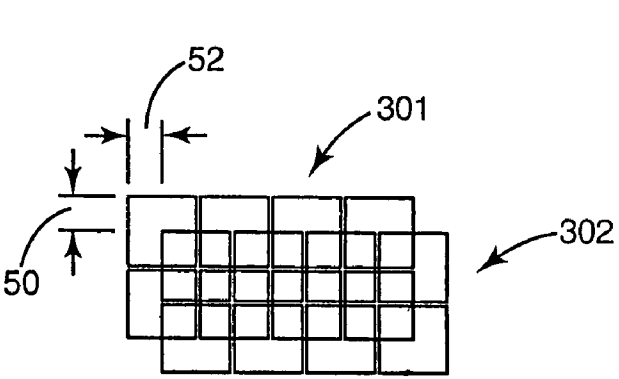
FIGS. 2A-2C are schematic illustrations of one embodiment of processing and displaying a frame of an image according to the present invention.
Figure 2B:
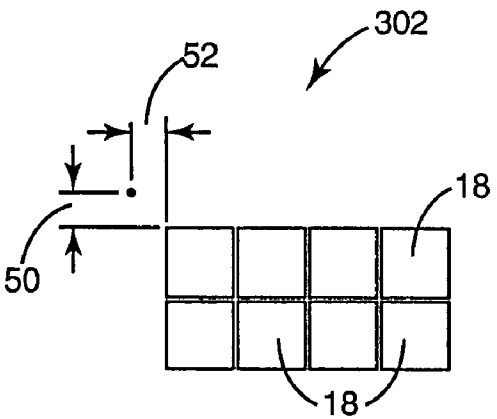
Figure 2A:
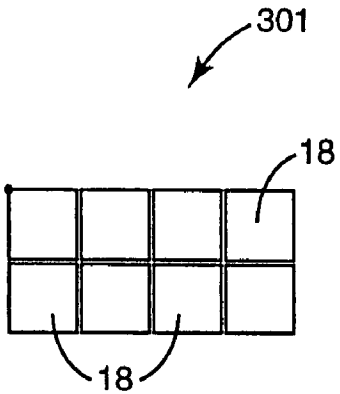

In one embodiment, as illustrated in FIGS. 2A and 2B, image processing unit 24 defines a plurality of image sub-frames 30 for image frame 28. More specifically, image processing unit 24 defines a first sub-frame 301 and a second sub-frame 302 for image frame 28. As such, first sub-frame 301 and second sub-frame 302 each include a plurality of columns and a plurality of rows of individual pixels 18 of image data 16. Thus, first sub-frame 301 and second sub-frame 302 each constitute an image data array or pixel matrix of a subset of image data 16.

In one embodiment, as illustrated in FIG. 2B, second sub-frame 302 is offset from first sub-frame 301 by a vertical distance 50 and a horizontal distance 52. As such, second sub-frame 302 is spatially offset from first sub-frame 301 by a predetermined distance. In one illustrative embodiment, vertical distance 50 and horizontal distance 52 are each approximately one-half of one pixel.

As illustrated in FIG. 2C, display device 26 alternates between displaying first sub-frame 301 in a first position and displaying second sub-frame 302 in a second position spatially offset from the first position. More specifically, display device 26 shifts display of second sub-frame 302 relative to display of first sub-frame 301 by vertical distance 50 and horizontal distance 52. As such, pixels of first sub-frame 301 overlap pixels of second sub-frame 302. In one embodiment, display device 26 completes one cycle of displaying first sub-frame 301 in the first position and displaying second sub-frame 302 in the second position for image frame 28. Thus, second sub-frame 302 is spatially and temporally displayed relative to first sub-frame 301.

Figure 3C:
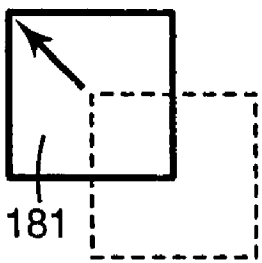
FIGS. 3A-3C are schematic illustrations of one embodiment of displaying a pixel with an image display system according to the present invention.
Figure 3B:
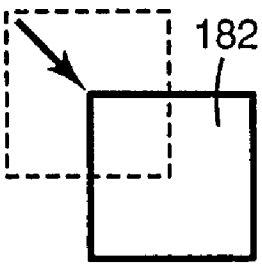
Figure 3A:
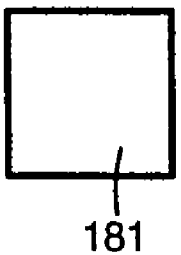

FIGS. 3A-3C illustrate one embodiment of completing one cycle of displaying a pixel 181 from first sub-frame 301 in the first position and displaying a pixel 182 from second sub-frame 302 in the second position. More specifically, FIG. 3A illustrates display of pixel 181 from first sub-frame 301 in the first position, FIG. 3B illustrates display of pixel 182 from second sub-frame 302 in the second position (with the first position being illustrated by dashed lines), and FIG. 3C illustrates display of pixel 181 from first sub-frame 301 in the first position (with the second position being illustrated by dashed lines).

Figure 5:
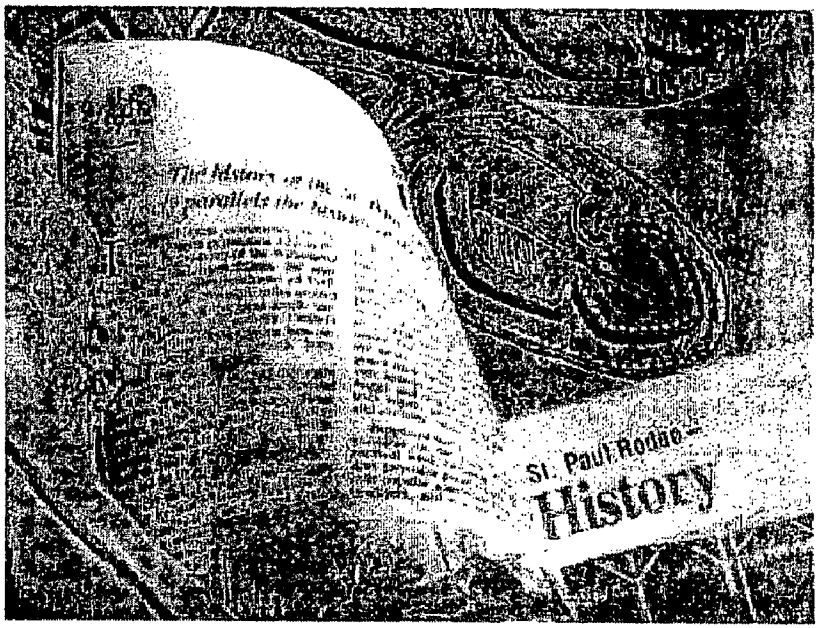
FIG. 5 is a simulation of one embodiment of an enlarged image portion produced with processing by an image display system according to the present invention.
Figure 4:
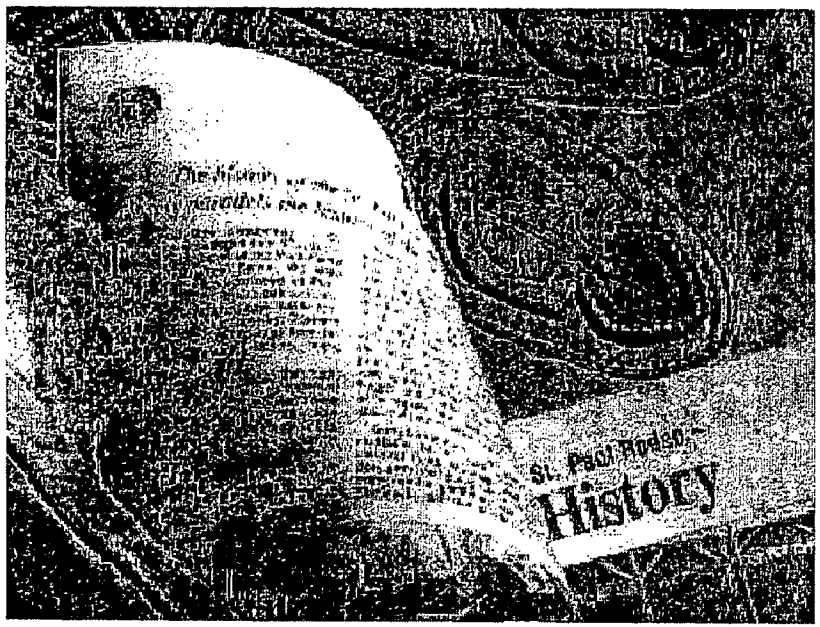
FIG. 4 is a simulation of one embodiment of an enlarged image portion produced without processing by an image display system according to the present invention.

FIGS. 4 and 5 illustrate enlarged image portions produced from the same image data without and with, respectively, image processing by image display system 10. More specifically, FIG. 4 illustrates an enlarged image portion 60 produced without processing by image display system 10. As illustrated in FIG. 4, enlarged image portion 60 appears pixelated with individual pixels being readily visible. In addition, enlarged image portion 60 is of a lower resolution.

FIG. 5, however, illustrates an enlarged image portion 62 produced with processing by image display system 10. As illustrated in FIG. 5, enlarged image portion 62 does not appear as pixelated as enlarged image portion 60 of FIG. 4. Thus, image quality of enlarged image portion 62 is enhanced with image display system 10. More specifically, resolution of enlarged image portion 62 is improved or increased compared to enlarged image portion 60.

In one illustrative embodiment, enlarged image portion 62 is produced by two-position processing including a first sub-frame and a second sub-frame, as described above. Thus, twice the amount of pixel data is used to create enlarged image portion 62 as compared to the amount of pixel data used to create enlarged image portion 60. Accordingly, with two-position processing, the resolution of enlarged image portion 62 is increased relative to the resolution of enlarged image portion 60 by a factor of approximately 1.4 or the square root of two.

In another embodiment, as illustrated in FIGS. 6A-6D, image processing unit 24 defines a plurality of image sub-frames 30 for image frame 28. More specifically, image processing unit 24 defines a first sub-frame 301, a second sub-frame 302, a third sub-frame 303, and a fourth sub-frame 304 for image frame 28. As such, first sub-frame 301, second sub-frame 302, third sub-frame 303, and fourth sub-frame 304 each include a plurality of columns and a plurality of rows of individual pixels 18 of image data 16.

Figure 6A:
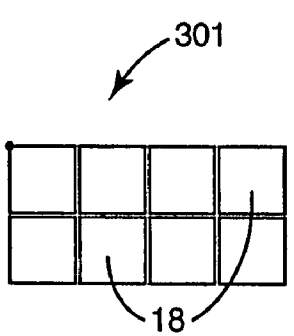
FIGS. 6A-6E are schematic illustrations of another embodiment of processing and displaying a frame of an image according to the present invention.
Figure 6B:
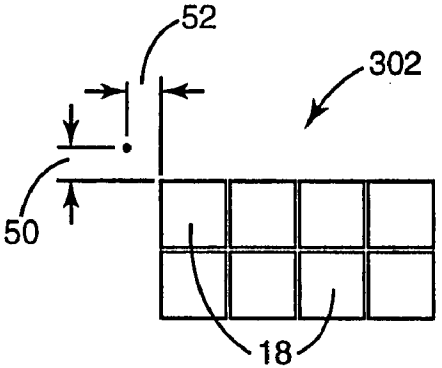
Figure 6C:
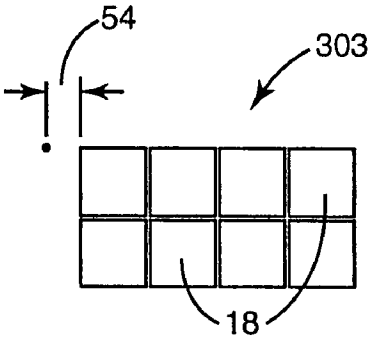
Figure 6D:
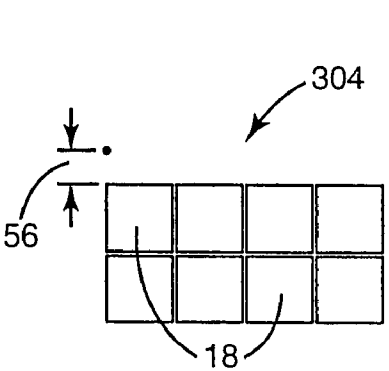

In one embodiment, as illustrated in FIG. 6B-6D, second sub-frame 302 is offset from first sub-frame 301 by a vertical distance 50 and a horizontal distance 52, third sub-frame 303 is offset from first sub-frame 301 by a horizontal distance 54, and fourth sub-frame 304 is offset from first sub-frame 301 by a vertical distance 56. As such, second sub-frame 302, third sub-frame 303, and fourth sub-frame 304 are each spatially offset from each other and spatially offset from first sub-frame 301 by a predetermined distance. In one illustrative embodiment, vertical distance 50, horizontal distance 52, horizontal distance 54, and vertical distance 56 are each approximately one-half of one pixel.

Figure 6E:
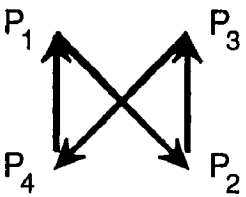

As illustrated schematically in FIG. 6E, display device 26 alternates between displaying first sub-frame 301 in a first position $P_1$, displaying second sub-frame 302 in a second position $P_2$ spatially offset from the first position, displaying third sub-frame 303 in a third position $P_3$ spatially offset from the first position, and displaying fourth sub-frame 304 in a fourth position $P_4$ spatially offset from the first position. More specifically, display device 26 shifts display of second sub-frame 302, third sub-frame 303, and fourth sub-frame 304 relative to first sub-frame 301 by the respective predetermined distance. As such, pixels of first sub-frame 301, second sub-frame 302, third sub-frame 303, and fourth sub-frame 304 overlap each other.

In one embodiment, display device 26 completes one cycle of displaying first sub-frame 301 in the first position, displaying second sub-frame 302 in the second position, displaying third sub-frame 303 in the third position, and displaying fourth sub-frame 304 in the fourth position for image frame 28. Thus, second sub-frame 302, third sub-frame 303, and fourth sub-frame 304 are spatially and temporally displayed relative to each other and relative to first sub-frame 301.

Figure 7A:
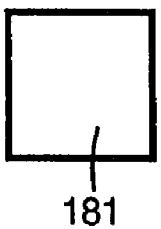
FIGS. 7A-7E are schematic illustrations of one embodiment of displaying a pixel with an image display system according to the present invention.
Figure 7B:
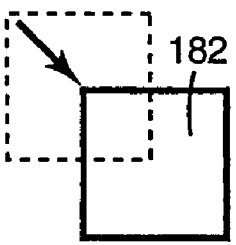
Figure 7C:
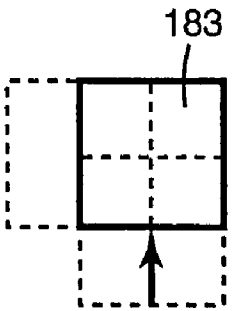
Figure 7D:
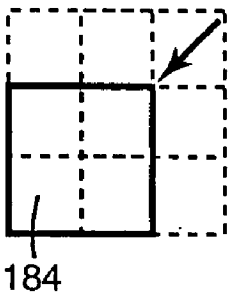
Figure 7E:
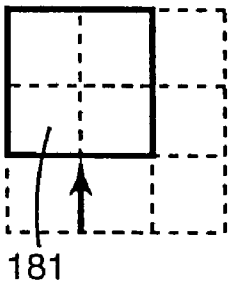

FIGS. 7A-7E illustrate one embodiment of completing one cycle of displaying a pixel 181 from first sub-frame 301 in the first position, displaying a pixel 182 from second sub-frame 302 in the second position, displaying a pixel 183 from third sub-frame 303 in the third position, and displaying a pixel 184 from fourth sub-frame 304 in the fourth position. More specifically, FIG. 7A illustrates display of pixel 181 from first sub-frame 301 in the first position, FIG. 7B illustrates display of pixel 182 from second sub-frame 302 in the second position (with the first position being illustrated by dashed lines), FIG. 7C illustrates display of pixel 183 from third sub-frame 303 in the third position (with the first position and the second position being illustrated by dashed lines), FIG. 7D illustrates display of pixel 184 from fourth sub-frame 304 in the fourth position (with the first position, the second position, and the third position being illustrated by dashed lines), and FIG. 7E illustrates display of pixel 181 from first sub-frame 301 in the first position (with the second position, the third position, and the fourth position being illustrated by dashed lines).

Figure 9:
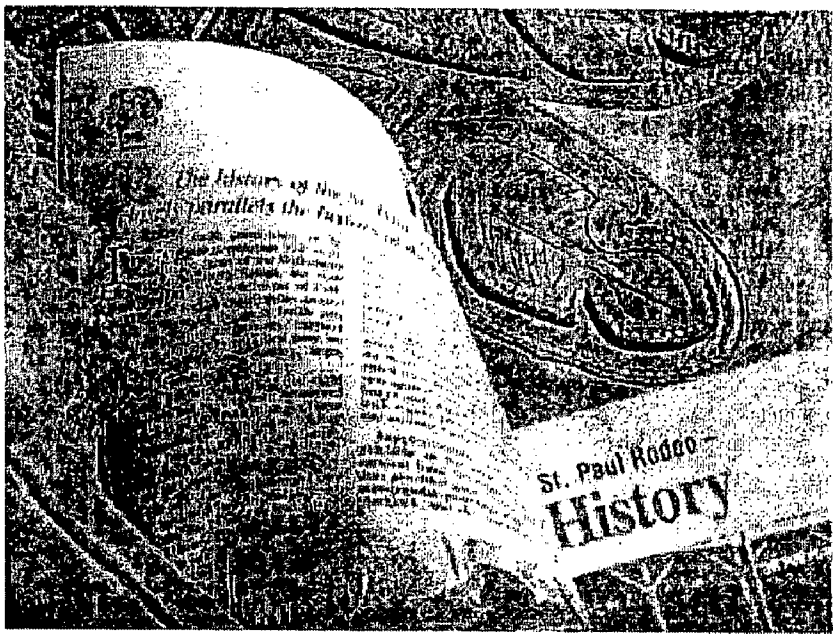
FIG. 9 is a simulation of another embodiment of an enlarged image portion produced with processing by an image display system according to the present invention.
Figure 8:
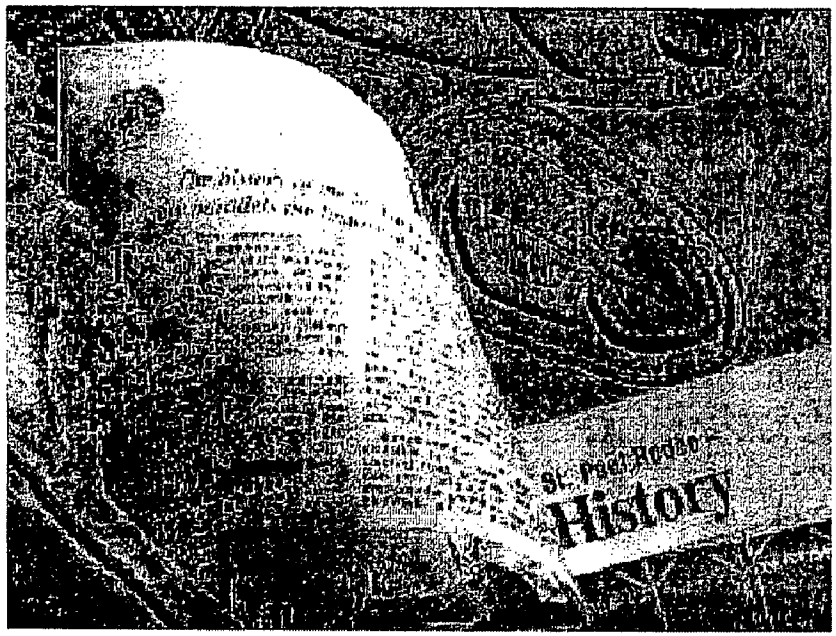
FIG. 8 is a simulation of another embodiment of an enlarged image portion produced without processing by an image display system according to the present invention.

FIGS. 8 and 9 illustrate enlarged image portions produced from the same image data without and with, respectively, image processing by image display system 10. More specifically, FIG. 8 illustrates an enlarged image portion 64 produced without processing by image display system 10. As illustrated in FIG. 8, areas of enlarged image portion 64 appear pixelated with individual pixels including, for example, pixels forming and/or outlining letters of enlarged image portion 64 being readily visible.

FIG. 9, however, illustrates an enlarged image portion 66 produced with processing by image display system 10. As illustrated in FIG. 9, enlarged image portion 66 does not appear pixelated compared to enlarged image portion 64 of FIG. 8. Thus, image quality of enlarged image portion 66 is enhanced with image display system 10. More specifically, resolution of enlarged image portion 66 is improved or increased compared to enlarged image portion 64.

In one illustrative embodiment, enlarged image portion 66 is produced by four-position processing including a first sub-frame, a second sub-frame, a third sub-frame, and a fourth sub-frame, as described above. Thus, four times the amount of pixel data is used to create enlarged image portion 66 as compared to the amount of pixel data used to create enlarged image portion 64. Accordingly, with four-position processing, the resolution of enlarged image portion 64 is increased relative to the resolution of enlarged image portion 64 by a factor of two or the square root of four. Four-position processing, therefore, allows image data 16 to be displayed at double the resolution of display device 26 since double the number of pixels in each axis (x and y) gives four times as many pixels.

By defining a plurality of image sub-frames 30 for image frame 28 and spatially and temporally displaying image sub-frames 30 relative to each other, image display system 10 can produce displayed image 14 with a resolution greater than that of display device 26. In one illustrative embodiment, for example, with image data 16 having a resolution of 800 pixels by 600 pixels and display device 26 having a resolution of 800 pixels by 600 pixels, four-position processing by image display system 10 with resolution adjustment of image data 16 produces displayed image 14 with a resolution of 1600 pixels by 1200 pixels. Accordingly, with lower resolution image data and a lower resolution display device, image display system 10 can produce a higher resolution displayed image. In another illustrative embodiment, for example, with image data 16 having a resolution of 1600 pixels by 1200 pixels and display device 26 having a resolution of 800 pixels by 600 pixels, four-position processing by image display system 10 without resolution adjustment of image data 16 produces displayed image 14 with a resolution of 1600 pixels by 1200 pixels. Accordingly, with higher resolution image data and a lower resolution display device, image display system 10 can produce a higher resolution displayed image. In addition, by overlapping pixels of image sub-frames 30 while spatially and temporally displaying image sub-frames 30 relative to each other, image display system 10 can reduce the "screen-door" effect caused, for example, by gaps between adjacent micro-mirror devices of a light modulator.

By buffering image data 16 to create image frame 28 and decouple a timing of image data 16 from a frame rate of display device 26 and displaying an entire sub-frame 30 for image frame 28 at once, image display system 10 can produce displayed image 14 with improved resolution over the entire image. In addition, with image data of a resolution equal to or greater than a resolution of display device 26, image display system 10 can produce displayed image 14 with an increased resolution greater than that of display device 26. To produce displayed image 14 with a resolution greater than that of display device 26, higher resolution data can be supplied to image display system 10 as original image data or synthesized by image display system 10 from the original image data. Alternatively, lower resolution data can be supplied to image display system 10 and used to produce displayed image 14 with a resolution greater than that of display device 26. Use of lower resolution data allows for sending of images at a lower data rate while still allowing for higher resolution display of the data. Thus, use of a lower data rate may enable lower speed data interfaces and result in potentially less EMI radiation.

Error Hiding

Figure 10:
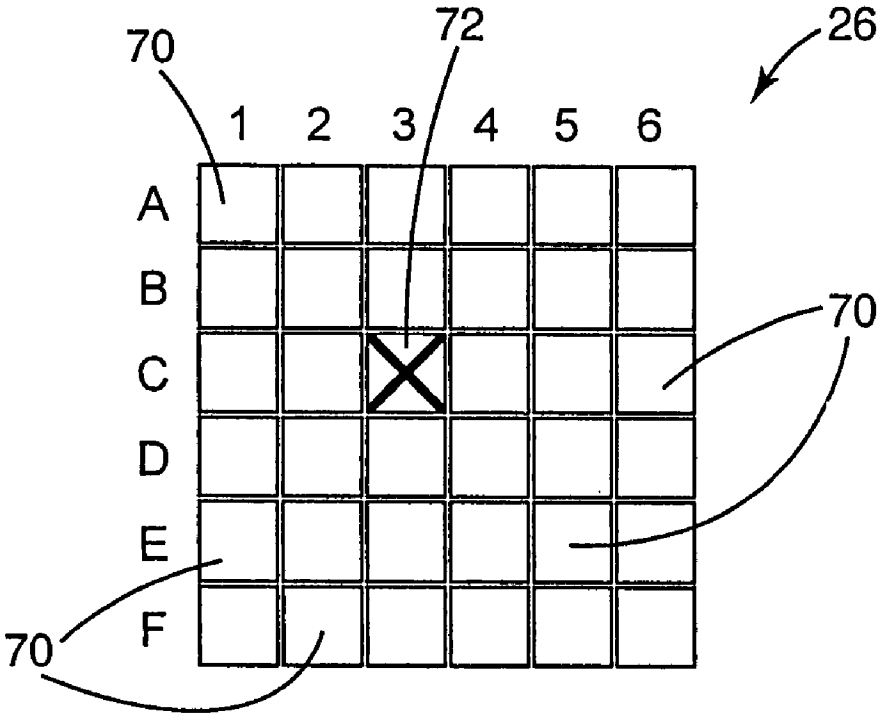
FIG. 10 is a schematic illustration of one embodiment of display pixels of a display device according to the present invention.

In one embodiment, as illustrated in FIG. 10, display device 26 includes a plurality of columns and a plurality of rows of display pixels 70. Display pixels 70 modulate light to display image sub-frames 30 for image frame 28 and produce displayed image 14. Each display pixel 70 may include all three color parts, namely, red, green, and blue. In that case, each display pixel 70 of display device 26 is capable of producing a full gamut of colors for display.

In one illustrative embodiment, display device 26 includes a 6×6 array of display pixels 70. Display pixels 70 are identified, for example, by row (A-F) and column (1-6). While display device 26 is illustrated as including a 6×6 array of display pixels, it is understood that the actual number of display pixels 70 in display device 26 may vary.

In one embodiment, one or more display pixels 70 of display device 26 may be defective. In one embodiment, display pixel 70 in location C3 is a defective display pixel 72. A defective display pixel is defined to include an aberrant or inoperative display pixel of display device 26 such as a display pixel which exhibits only an "ON" or an "OFF" position, a display pixel which produces less intensity or more intensity than intended, and/or a display pixel with inconsistent or random operation.

In one embodiment, image display system 10 diffuses the affect of a defective display pixel or pixels of display device 26. As described below, image display system 10 diffuses the affect of a defective display pixel or pixels by separating or dispersing areas of displayed image 14 which are produced by a defective display pixel of display device 26.

Figure 11:
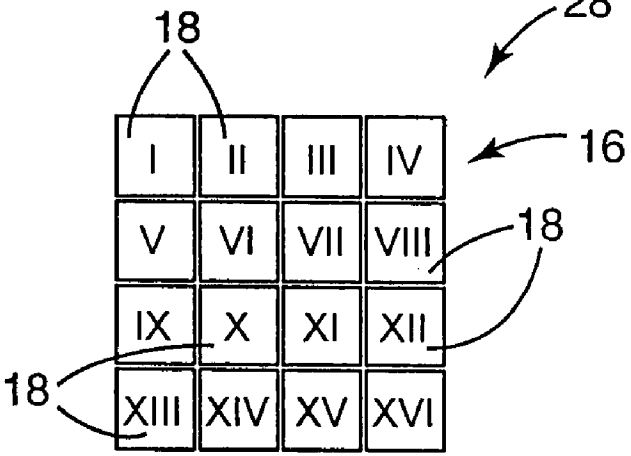
FIG. 11 is a schematic illustration of one embodiment of image data for an image frame according to the present invention.

FIG. 11 illustrates one embodiment of image frame 28 for image 12. As described above, image data 16 for image 12 is buffered to create image frame 28 such that image frame 28 includes a plurality of columns and a plurality of rows of individual pixels 18 of image data 16. In one illustrative embodiment, image frame 28 includes a 4×4 array of pixels 18. Pixels 18 of image data 16 are identified, for example, by roman numerals I-XVI.

In one embodiment, as illustrated in FIGS. 12A-12D, image processing unit 24 defines a plurality of image sub-frames 30' (FIG. 1) for image frame 28. More specifically, image processing unit 24 defines a first image sub-frame 301', a second image sub-frame 302', a third image sub-frame 303', and a fourth image sub-frame 304' for image frame 28. First image sub-frame 301', second image sub-frame 302', third image sub-frame 303', and fourth image sub-frame 304', each include image data 16 for image frame 28 and, in one embodiment, are each of an area equal to that of display device 26. As such, a top left of each image sub-frame 30' is indexed or mapped to display pixel Al of display device 26 (FIG. 10), as described below.

Figure 13A:
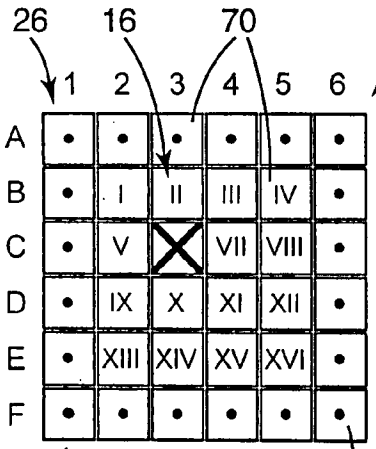
FIGS. 13A-13D are schematic illustrations of one embodiment of displayed image portions for the image frame of FIG. 11 produced with the image sub-frames of FIGS. 12A-12D.

In one embodiment, image data 16 is of an area less than that of display device 26. As such, image data 16 can be shifted among display pixels 70 of display device 26 to diffuse the affect of a defective display pixel, as described below. Thus, display pixels 70 outside of image data 16 are identified as blank display pixels 74 (FIG. 13A).

In one embodiment, image processing unit 24 scales image data 16 so as to be of a size less than that of display device 26. In one embodiment, display device 26 is of a size greater than a standard size of image data 16. For example, in one illustrative embodiment, display device 26 has a size of 602 pixels by 802 pixels so as to accommodate image data 16 of a standard size of 600 pixels by 800 pixels.

Figure 12A:
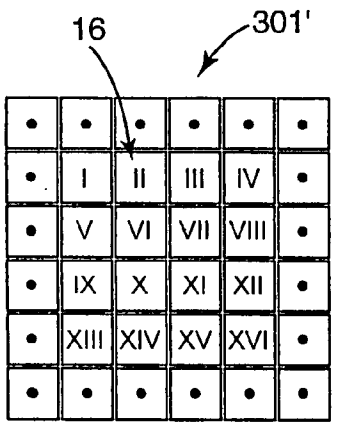
FIGS. 12A-12D are schematic illustrations of one embodiment of image sub-frames for the image frame of FIG. 11.
Figure 12B:
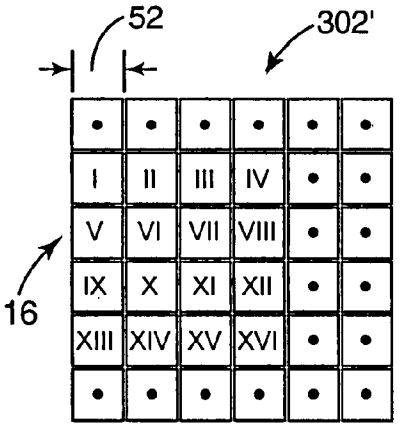
Figure 12C:
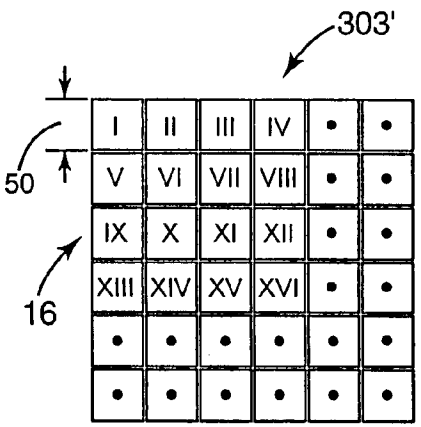
Figure 12D:
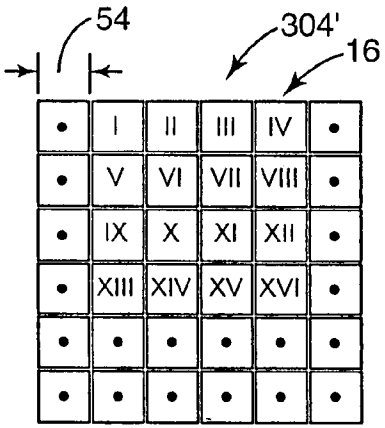

In one embodiment, as illustrated in FIGS. 12B-12D, image data 16 of second image sub-frame 302' is offset from image data 16 of first image sub-frame 301' by horizontal distance 52, image data 16 of third image sub-frame 303' is offset from image data 16 of second image sub-frame 302' by vertical distance 50, and image data 16 of fourth image sub-frame 304' is offset from image data 16 of third image sub-frame 303' by horizontal distance 54. As such, image data 16 of first image sub-frame 301', image data 16 of second image sub-frame 302', image data 16 of third image sub-frame 303', and image data 16 of fourth image sub-frame 304', are spatially offset from each other by a predetermined distance. In one embodiment, the predetermined distance includes n pixels, wherein n is a whole number. In one illustrative embodiment, as illustrated in FIGS. 12B-12D, horizontal distance 52, vertical distance 50, and horizontal distance 54 are each one pixel.

In one embodiment, as illustrated in FIGS. 13A-13D, display device 26 alternates between displaying first image sub-frame 301', second image sub-frame 302', third image sub-frame 303', and fourth image sub-frame 304' for image frame 28. In one embodiment, first image sub-frame 301', second image sub-frame 302', third image sub-frame 303', and fourth image sub-frame 304', are each displayed with display device 26 such that the top left of each image sub-frame 30' is mapped to display pixel A1 of display device 26. However, with image data 16 being offset in each of second image sub-frame 302', third image sub-frame 303', and fourth image sub-frame 304' relative to first image sub-frame 301', different display pixels 70 of display device 26 display image data 16 for first image sub-frame 301', second image sub-frame 302', third image sub-frame 303', and fourth image sub-frame 304'.

For example, as illustrated in FIG. 13A, display pixels B2-E5 display image data 16 of first image sub-frame 301' as a displayed image portion 141. However, since display pixel 70 in location C3 is a defective display pixel, pixel VI of image data 16 as displayed for first image sub-frame 301' of image frame 28 is defective.

Figure 13B:
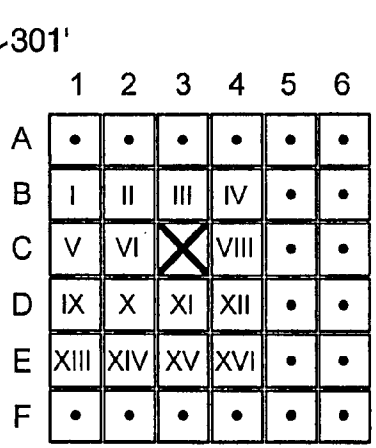

As illustrated in FIG. 13B, display pixels B1-E4 display image data 16 for second image sub-frame 302' as a displayed image portion 142. However, since display pixel 70 in location C3 is a defective display pixel, pixel VII of image data 16 as displayed for second image sub-frame 302' of image frame 28 is defective.

Figure 13C:
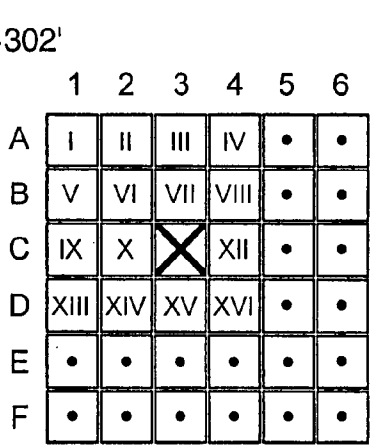

As illustrated in FIG. 13C, display pixels A1-D4 display image data 16 for third image sub-frame 303' as a displayed image portion 143. However, since display pixel 70 in location C3 is a defective display pixel, pixel XI of image data 16 as displayed for third image sub-frame 303' of image frame 28 is defective.

Figure 13D:
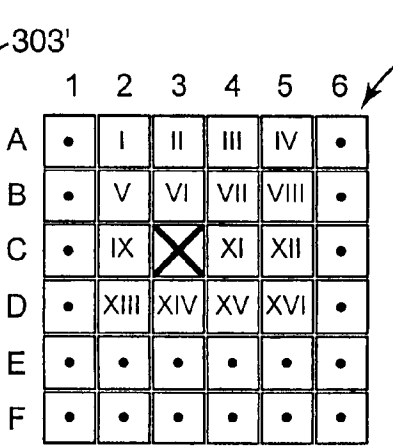

As illustrated in FIG. 13D, display pixels A2-D5 display image data 16 for fourth image sub-frame 304' as a displayed image portion 144. However, since display pixel 70 in location C3 is a defective display pixel, pixel X of image data 16 as displayed for fourth image sub-frame 304' of image frame 28 is defective.

In one embodiment, as illustrated in FIGS. 14A-14D, display device 26 displays displayed image portions 141, 142, 143, and 144 in the same display position. More specifically, display device 26 shifts display of displayed image portions 142, 143, and 144 so as to coincide with the display of displayed image portion 141 in display positions ai-div. As such, display device 26 displays all displayed image portions 141, 142, 143, and 144 in display positions ai-div.

Since pixel VI of displayed image portion 141 is created with a defective display pixel, the pixel for display position bii is defective for displayed image portion 141. In addition, since pixel VII of displayed image portion 142 is created with a defective display pixel, the pixel for display position biii is defective for displayed image portion 142. In addition, since pixel XI of displayed image portion 143 is created with a defective display pixel, the pixel for display position ciii is defective for displayed image portion 143. Furthermore, since pixel X of displayed image portion 144 is created with a defective display pixel, the pixel for display position cii is defective for displayed image portion 144.

Figure 14A:
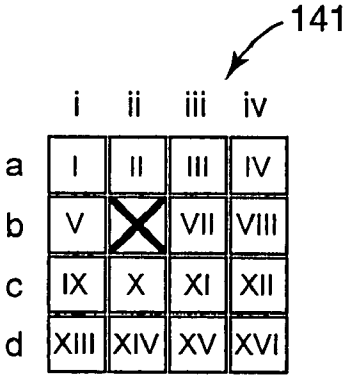
FIGS. 14A-14D are schematic illustrations of one embodiment of display of the displayed image portions of FIGS. 13A-13D.
Figure 14B:
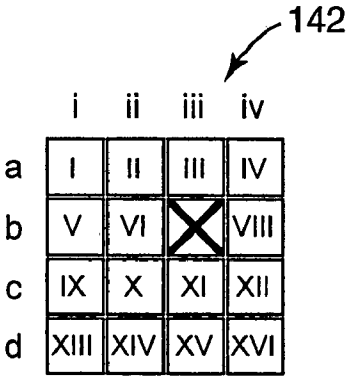
Figure 14C:
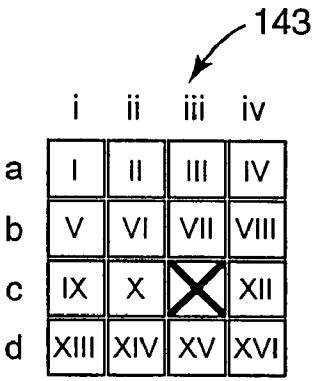
Figure 14D:
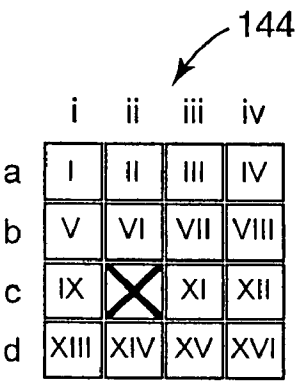
Figure 14E:
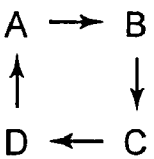
FIG. 14E is a schematic illustration of one embodiment of shifting the displayed image portions of FIGS. 14A-14D.

In one embodiment, as illustrated in FIG. 14E, displayed image portions 141, 142, 143, and 144 produced from image sub-frames 301', 302', 303', and 304', respectively, are shifted according to the offset distance of the respective image sub-frames 30'. More specifically, displayed image portions 142, 143, and 144 are each shifted in a direction opposite the direction by which image data 16 of image sub-frames 302', 303', and 304', respectively, are offset relative to each other.

For example, in one embodiment, image data 16 of image sub-frame 302' is shifted to the left (as illustrated in FIG. 12B) relative to image data 16 of image sub-frame 301'. As such, displayed image portion 142 is shifted to the right from position A to position B. In addition, image data 16 of image sub-frame 303' is shifted up (as illustrated in FIG. 12C) relative to image data 16 of image sub-frame 302'. As such, displayed image portion 143 is shifted down from position B to position C. Furthermore, image data 16 of image sub-frame 304' is shifted to the right (as illustrated in FIG. 12D) relative to image data 16 of image sub-frame 303'. As such, displayed image portion 144 is shifted to the left from position C to position D. Thus, pixels I-XVI of image data 16 for each image sub-frame 30' of image frame 28 of image 12 are displayed in the same display positions, namely, display positions ai-div, as illustrated in FIGS. 14A-14D.

In one embodiment, image shifter 38 (FIG. 1) of display device 26 shifts display of image sub-frames 30' as described above. More specifically, image shifter 38 shifts display of second image sub-frame 302', third image sub-frame 303', and fourth image sub-frame 304' to the display position of first image sub-frame 301' so as to align displayed image portions 142,143, and 144 with displayed image portion 141. Thus, image data within image sub-frames 30' is properly aligned.

As illustrated in FIG. 15, displayed image portions 141, 142, 143, and 144 each contribute to displayed image 14. As such, pixels I-XVI of image data 16 for each image sub-frame 301', 302', 303', and 304' contribute to display positions ai-div. Thus, each display position ai-div displays the corresponding pixels of image data 16. For example, display position ai displays pixel I of image data 16 for image sub-frames 301', 302', 303', and 304', as represented by $I_A+I_B+I_C+I_D$, where $I_A$ represents pixel I of image data 16 for image sub-frame 301', $I_B$ represents pixel I of image data 16 for image sub-frame 302', $I_C$ represents pixel I of image data 16 for image sub-frame 303', and $I_D$ represents pixel I of image data 16 for image sub-frame 304'.

Since display pixel 70 in location C3 is a defective display pixel, pixel VI of image data 16 for first image sub-frame 301' is defective, pixel VII of image data 16 for second image sub-frame 302' is defective, pixel XI of image data 16 for third image sub-frame 303' is defective, and pixel X of image data 16 for fourth image sub-frame 304' is defective (FIGS. 14A-14D). As such, display position bii is represented by $D_A+VI_B+VI_C+VI_D$, display position biii is represented by $VII_A+D_B+VII_C+VII_D$, display position ciii is represented by $XI_A+XI_B+D_C+XI_D$, and display position cii is represented by $X_A+X_B+X_C+D_D$, where $D_A$, $D_B$, $D_C$, and $D_D$ represent defective pixels from first image sub-frame 301', second image sub-frame 302', third image sub-frame 303', and fourth image sub-frame 304', respectively. Thus, defective display pixel 72 in location C3 of display device 26 contributes to one of four pixels for each pixel of displayed image 14 in display positions bii, biii, ciii, and cii. Accordingly, in one embodiment, the contribution of a defective display pixel to a pixel of the displayed image is distributed or diffused so as to be equal to 1/D, where D is the number of display pixels touched by the defective display pixel.

Since pixels of displayed image 14 in each of the display positions ai-div are produced by four independent display pixels 70 of display device 26 (for example, $I_A+I_B+I_C+I_D$), pixels of displayed image 14 appear as an average of the four independent display pixels. Thus, brightness or intensity of each pixel of displayed image 14 includes the average brightness or intensity of four independent display pixels.

In one embodiment, as described above and illustrated in FIG. 14E, four image sub-frames 30' are created such that displayed image portions 141, 142, 143, and 144 are shifted in a four-position "box" pattern to produce displayed image 14. As such, in one embodiment, image data 16 of second image sub-frame 302' is offset a horizontal distance from image data 16 of first image sub-frame 301', image data 16 of third image sub-frame 303' is offset a vertical distance from image data 16 of second image sub-frame 302', and image data 16 of fourth image sub-frame 304' is offset a horizontal distance from image data 16 of third image sub-frame 303' such that the horizontal distance and the vertical distance are both n pixels. Thus, image sub-frames 30' are shifted between respective positions A, B, C, and D. In one embodiment, n is a whole number. In another embodiment, n is greater than one and is a non-integer.

Figure 16:
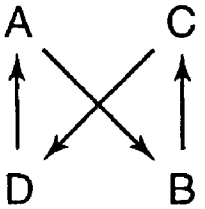
FIG. 16 is a schematic illustration of another embodiment of shifting displayed image portions for a displayed image produced with an image display system according to the present invention.

In one embodiment, as illustrated in FIG. 16, four image sub-frames 30' are created such that displayed image portions 141, 142, 143, and 144 are shifted in a four-position "bow-tie" pattern. As such, in one embodiment, image data 16 of second image sub-frame 302' is offset a horizontal distance and a vertical distance from image data 16 of first image sub-frame 301', image data 16 of third image sub-frame 303' is offset a vertical distance from image data 16 of second image sub-frame 302', and image data 16 of fourth image sub-frame 304' is offset a horizontal distance and a vertical distance from image data 1 6 of third image sub-frame 303' such that the horizontal distance and the vertical distance are both n pixels. Thus, image sub-frames 30' are shifted between respective positions A, B, C, and D. In one embodiment, n is a whole number. In another embodiment, n is greater than one and is a non-integer.

Figure 17:
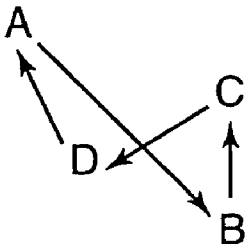
FIG. 17 is a schematic illustration of another embodiment of shifting displayed image portions for a displayed image produced with an image display system according to the present invention.

In one embodiment, as illustrated in FIG. 17, four image sub-frames 30' are created such that displayed image portions 141, 142, 143, and 144 are shifted in a four-position "scramble" pattern. As such, in one embodiment, image data 16 of second image sub-frame 302' is offset a horizontal distance and a vertical distance from image data 16 of first image sub-frame 301', image data 16 of third image sub-frame 303' is offset a vertical distance from image data 16 of second image sub-frame 302', and image data 16 of fourth image sub-frame 304' is offset a horizontal distance and a vertical distance from image data 16 of third image sub-frame 303' such that the horizontal distances and the vertical distances include n pixels and m pixels, respectively. Thus, image sub-frames 30' are shifted between respective positions A, B, C, and D. In one embodiment, n and m are whole numbers and are not equal to each other. In another embodiment, n and m are each greater than one and are non-integers.

In one embodiment, a first image frame 28 is created for a first image and a second image frame 28' is created for a second image. In addition, in one embodiment, a first set of image sub-frames 30' are defined for first image frame 28 and a second set of image sub-frames 30" are defined for second image frame 28'. The first set of image sub-frames 30' and the second set of image sub-frames 30" each include one or more sub-frames for the respective image frame. As such, a first set of displayed image portions for first image frame 28 are produced with the first set of image sub-frames 30' and a second set of displayed image portions for second image frame 28' are produced with the second set of image sub-frames 30". In one embodiment, first image frame 28 and second image frame 28' are created for one image. As such, multiple image frames are created for the image from image data 16.

Figure 18:
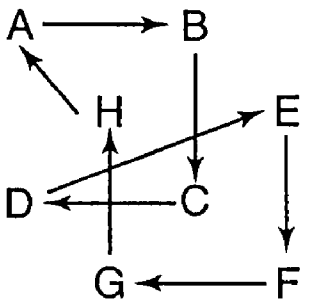
FIG. 18 is a schematic illustration of another embodiment of shifting displayed image portions for a displayed image produced with an image display system according to the present invention.

In one embodiment, as illustrated in FIG. 18, the first set of displayed image portions for first image frame 28 are shifted in a first pattern and the second set of displayed image portions for second image frame 28' are shifted in a second pattern. In one embodiment, the second pattern is offset from the first pattern. In addition, the second pattern may be the same or different from the first pattern. As such, a first set of display pixels are used to display the first set of image sub-frames 30' and a second set of display pixels are used to display the second set of image sub-frames 30".

In one embodiment, image data 16 of second image sub-frame 302' is offset a horizontal distance from image data 16 of first image sub-frame 301' for each set of image sub-frames 30' and 30", image data 16 of third image sub-frame 303' is offset a vertical distance from image data 16 of second image sub-frame 302' for each set of image sub-frames 30' and 30", image data 16 of fourth image sub-frame 304' is offset a horizontal distance from image data 16 of third image sub-frame 303' for each set of image sub-frames 30' and 30" such that the horizontal distance and the vertical distance are both n pixels. Thus, image sub-frames 30' are shifted between respective positions A, B, C, and D, and image sub-frames 30" are shifted between respective positions E, F, G, and H. In one embodiment, n is a whole number. In another embodiment, n is greater than one and is a non-integer.

Figure 19:
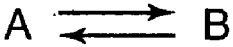
FIG. 19 is a schematic illustration of another embodiment of shifting displayed image portions for a displayed image produced with an image display system according to the present invention.

In one embodiment, as illustrated in FIG. 19, two image sub-frames 30' are created such that displayed image portions 141 and 142 are shifted in a two-position horizontal pattern. As such, image data 16 of second image sub-frame 302' is offset a horizontal distance from image data 16 of first image sub-frame 301', where the horizontal distance includes n pixels. Thus, image sub-frames 30' are shifted between respective positions A and B. In one embodiment, n is a whole number. In another embodiment, n is greater than one and is a non-integer.

Figure 20:
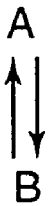
FIG. 20 is a schematic illustration of another embodiment of shifting displayed image portions for a displayed image produced with an image display system according to the present invention.

In one embodiment, as illustrated in FIG. 20, two image sub-frames 30' are created such that displayed image portions 141 and 142 are shifted in a two-position vertical pattern. As such, image data 16 of second image sub-frame 302' is offset a vertical distance from image data 16 of first image sub-frame 301', where the vertical distance includes n pixels. Thus, image sub-frames 30' are shifted between respective positions A and B. In one embodiment, n is a whole number. In another embodiment, n is greater than one and is a non-integer.

Figure 21:
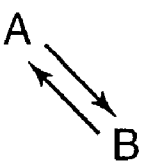
FIG. 21 is a schematic illustration of another embodiment of shifting displayed image portions for a displayed image produced with an image display system according to the present invention.

In one embodiment, as illustrated in FIG. 21, two image sub-frames 30' are created such that displayed image portions 141 and 142 are shifted in a two-position diagonal pattern. As such, image data 16 of second image sub-frame 302' is offset a horizontal distance and a vertical distance from image data 16 of first image sub-frame 301', where the horizontal distance and vertical distance include n pixels and m pixels, respectively. Thus, image sub-frames 30' are shifted between respective positions A and B. In one embodiment, n and m are whole numbers and are equal to each other. In another embodiment, n and m are whole numbers and are not equal to each other. In another embodiment, n and m are each greater than one and are non-integers.

Figure 23:
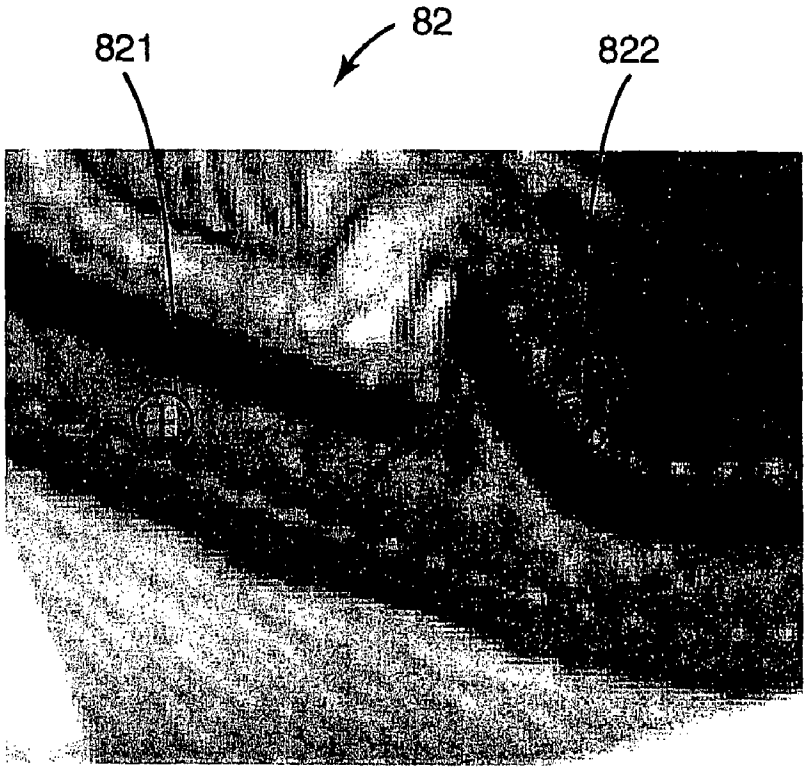
FIG. 23 is a simulation of one embodiment of an enlarged image portion produced with processing by an image display system including resolution enhancement and error hiding according to the present invention.
Figure 22:
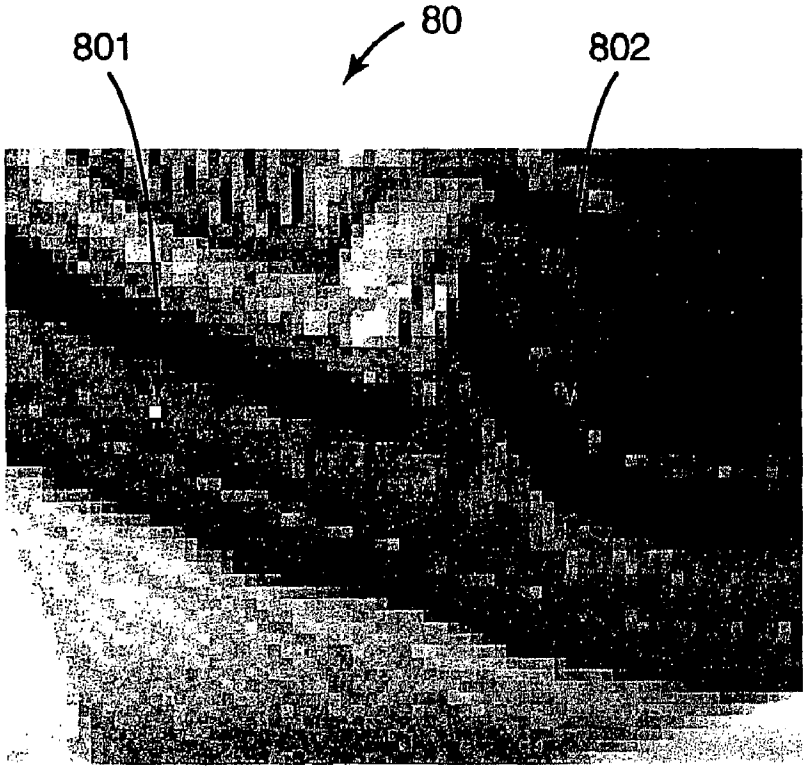
FIG. 22 is a simulation of one embodiment of an enlarged image portion produced without processing by an image display system according to the present invention.

FIGS. 22 and 23 illustrate enlarged image portions produced from the same image data without and with, respectively, image processing by image display system 10. More specifically, FIG. 22 illustrates an enlarged image portion produced without processing by image display system 10. As illustrated in FIG. 22, enlarged image portion 80 appears pixelated with individual pixels being readily visible. In addition, enlarged image portion 80 is of a lower resolution.

As illustrated in FIG. 22, two pixels of enlarged image portion 80 are produced with defective display pixels. More specifically, one pixel 801 of enlarged image portion 80 appears white as the display pixel corresponding to pixel 801 exhibits only an "ON" position. In addition, another pixel 802 of enlarged image portion 80 appears black as the display pixel corresponding to pixel 802 exhibits only an "OFF" position. The affect of these defective display pixels is readily visible in enlarged image portion 80.

FIG. 23, however, illustrates an enlarged image portion 82 produced with processing by image display system 10 including resolution enhancement and error hiding, as described above. As illustrated in FIG. 23, enlarged image portion 82 does not appear pixelated compared to enlarged image portion 80 of FIG. 22. Thus, image quality of enlarged image portion 82 is enhanced with image display system 10. More specifically, resolution of enlarged image portion 82 is improved or increased compared to enlarged image portion 80.

In one illustrative embodiment, enlarged image portion 82 is produced by four-position processing including a first sub-frame, a second sub-frame, a third sub-frame, and a fourth sub-frame, as described above. Thus, four times the amount of pixel data is used to create enlarged image portion 82 as compared to the amount of pixel data used to create enlarged image portion 80. Accordingly, with four-position processing, the resolution of enlarged image portion 82 is increased relative to the resolution of enlarged image portion 80 by a factor of two or the square root of four. In addition, the affect of the defective display pixels is diffused. More specifically, the affect of the display pixel which exhibits only the "ON" position is distributed or diffused over a region 821 of enlarged image portion 82 including four pixels and the affect of the display pixel which exhibits only the "OFF" position is distributed or diffused over a region 822 of enlarged image portion 82 including four pixels. As such, the defective display pixels are not as noticeable in enlarged image portion 82 as compared to enlarged image portion 80.

In one embodiment, to increase the resolution of enlarged image portion 82 and diffuse the affect of the defective display pixels in enlarged image portion 82, the sub-frames used to produce enlarged image portion 82 are offset at least n pixels from each other, wherein n is greater than one and is a non-integer. Thus, the horizontal distance and/or the vertical distance between the sub-frames includes at least n pixels, wherein n is greater than one and is a non-integer.

In one embodiment, image display system 10 compensates for a defective display pixel or pixels of display device 26. More specifically, a defective display pixel or pixels of display device 26 is identified and image data 16 corresponding to the location of the defective display pixel or pixels in the displayed image is adjusted.

For example, as illustrated in FIG. 15, display position bii includes contribution from a defective display pixel. More specifically, pixel VI of displayed image portion 141 is created with a defective display pixel. Display position bii, however, also includes contributions from three other pixels including pixel VI of displayed image portion 142, pixel VI of displayed image portion 143, and pixel VI of displayed image portion 144. Accordingly, display position bii is represented by $D_A+VI_B+VI_C+VI_D$.

As illustrated in FIG. 13A, pixel VI of displayed image portion 141 is produced by the display pixel in location C3. Thus, with the display pixel in location C3 identified as a defective display pixel, image data for other pixels of display position bii is adjusted to compensate for the defective display pixel. More specifically, image data for pixel VI of displayed image portion 142, image data for pixel VI of displayed image portion 143, and/or image data for pixel VI of displayed image portion 144 is adjusted to compensate for pixel VI of displayed image portion 141.

As illustrated in FIGS. 13B, 13C, and 13D, respectively, pixel VI of displayed image portion 142 is produced by the display pixel in location C2, pixel VI of displayed image portion 143 is produced by the display pixel in location B2, and pixel VI of displayed image portion 144 is produced by the display pixel in location B3. Thus, neither pixel VI of displayed image portion 142, pixel VI of displayed image portion 143, nor pixel VI of displayed image portion 144 is affected by the defective display pixel in location C3.

In one embodiment, an intensity of image data 16 corresponding to the location of the defective display pixel or pixels in the displayed image is increased and/or decreased to compensate for the defective display pixel or pixels of display device 26. As such, the affect of the defective display pixel or pixels in the displayed image is reduced. The defective display pixel or pixels of display device 26 may be identified by user input, self-diagnostic input or sensing by display device 26, an external data source, and/or information stored in display device 26. In one embodiment, presence of a defective display pixel or pixels of display device 26 is communicated with image processing unit 24, as illustrated in FIG. 1.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of displaying an image with a display device, comprising:

receiving image data for the image and buffering the image data to create a frame of the image;

defining a first sub-frame and at least a second sub-frame for the frame of the image, image data of the second sub-frame being offset from image data of the first sub-frame by an offset distance; and displaying the first sub-frame with a first plurality of pixels of the display device and displaying the second sub-frame with a second plurality of pixels of the display device offset from the first plurality of pixels by the offset distance, wherein at least one of the pixels of the display device is identified as a defective pixel, and wherein displaying the first sub-frame and displaying the second sub-frame includes displaying a pixel of the first sub-frame and a pixel of the second sub-frame with the defective pixel and diffusing an affect of the defective pixel over at least a portion of the image.

2. The method of claim 1, wherein the offset distance includes at least one pixel.

3. The method of claim 1, further comprising:

compensating for the defective pixel, including adjusting image data of at least one of the first sub-frame and the second sub-frame corresponding to a location of the defective pixel in the image.

4. The method of claim 3, wherein adjusting the image data includes increasing an intensity of the image data of the at least one of the first sub-frame and the second sub-frame corresponding to the location of the defective pixel in the image.

5. The method of claim 3, wherein adjusting the image data includes decreasing an intensity of the image data of the at least one of the first sub-frame and the second sub-frame corresponding to the location of the defective pixel in the image.

6. The method of claim 1, wherein a presence of the defective pixel is communicated with an image processing unit coupled to the display device.

7. The method of claim 1, wherein the defective pixel is identified by user input.

8. The method of claim 1, wherein the defective pixel is identified by self-diagnostic input.

9. The method of claim 1, wherein the defective pixel is identified by sensing by the display device.

10. The method of claim 1, wherein the defective pixel is identified by an external data source.

11. The method of claim 1, wherein the defective pixel is identified by information stored in the display device.

12. The method of claim 1, further comprising:

scaling the image data so as to be of a size less than that of the display device to create scaled image data.

13. The method of claim 12, further comprising:

shifting the scaled image data among display pixels of the display device.

14. A system for displaying an image, comprising:

a buffer adapted to receive image data for the image and buffer the image data to create a frame of the image;

an image processing unit adapted to define a first sub-frame and at least a second sub-frame for the frame of the image, image data of the second sub-frame being offset from the image data of the first sub-frame by an offset distance; and a display device adapted to temporally display the first sub-frame with a first plurality of pixels and display the second sub-frame with a second plurality of pixels offset from the first plurality of pixels by the offset distance, wherein at least one of the pixels of the display device is identified as a defective pixel, and wherein the display device is adapted to display a pixel of the first sub-frame and a pixel of the second sub-frame with the defective pixel and diffuse an affect of the defective pixel over at least a portion of the image.

15. The system of claim 14, wherein the offset distance includes at least one pixel.

16. The system of claim 14, wherein the image processing unit is adapted to adjust image data of at least one of the first sub-frame and the second sub-frame corresponding to a location of the defective pixel in the image to compensate for the defective pixel.

17. The system of claim 16, wherein the image processing unit is adapted to increase an intensity of the image data of the at least one of the first sub-frame and the second sub-frame corresponding to the location of the defective pixel in the image.

18. The system of claim 16, wherein the image processing unit is adapted to decrease an intensity of the image data of the at least one of the first sub-frame and the second sub-frame corresponding to the location of the defective pixel in the image.

19. The system of claim 14, wherein a presence of the defective pixel is communicated with the image processing unit.

20. The system of claim 14, wherein the defective pixel is identified by user input.

21. The system of claim 14, wherein the defective pixel is identified by self-diagnostic input.

22. The system of claim 14, wherein the defective pixel is identified by sensing by the display device.

23. The system of claim 14, wherein the defective pixel is identified by an external data source.

24. The system of claim 14, wherein the defective pixel is identified by information stored in the display device.

25. The system of claim 14, wherein the image processing unit is adapted to scale the image data so as to be of a size less than that of the display device to create scaled image data.

26. The system of claim 25, wherein the image processing unit is adapted to shift the scaled image data among display pixels of the display device.

27. A method for displaying image data of an image with a display device having an array of pixels with at least one pixel identified as a defective pixel, the method comprising:

scaling the image data to a size less than an area of the array of pixels of the display device;

creating multiple frames each including a plurality of adjacent columns and a plurality of adjacent rows of pixels of the image from the image data;

positioning each of the multiple frames on the display device, including offsetting each of the multiple frames from one another by at least one pixel in at least one direction; and displaying each of the multiple frames with the display device to produce complete frames of respective portions of the image and display the image, including aligning the multiple frames with each other to diffuse an affect of the defective pixel in the displayed image.

28. The method of claim 27, wherein pixels of the displayed image are produced by at least four independent pixels of the display device.

29. The method of claim 27, wherein each pixel of the displayed image has an intensity that includes an average intensity of at least four independent pixels of the display device.

30. The method of claim 27, wherein the positioning of each of the multiple frames includes shifting the multiple frames in a four position box pattern to produce the displayed image.

31. The method of claim 27, wherein the positioning of each of the multiple frames includes shifting the multiple frames in a bow-tie pattern to produce the displayed image.

32. The method of claim 27, wherein the positioning of each of the multiple frames includes shifting the multiple frames in a scramble pattern to produce the displayed image.

33. The method of claim 27, further comprising:

identifying a location of the defective pixel.

34. The method of claim 27, further comprising:

adjusting the image data to compensate for the defective pixel.

* * * * *